US005482764A

United States Patent [19]

McBride et al.

[11] Patent Number: 5,482,764

[45] Date of Patent: Jan. 9, 1996

[54] METHOD FOR IMPROVING THE BLEACH RESISTANCE OF DYED TEXTILE FIBER AND PRODUCT MADE THEREBY

[75] Inventors: Daniel T. McBride, Chesnee; Carey N. Barry, Jr., Roebuck, both of S.C.

[73] Assignee: Milliken Research Corporation, Spartanburg, S.C.

[21] Appl. No.: 190,760

[22] Filed: Feb. 2, 1994

[51] Int. Cl.[6] ..... B32B 3/02

[52] U.S. Cl. ..... 428/96; 8/495; 8/496; 427/389.9; 427/393.2; 427/393.4; 428/265; 428/267

[58] Field of Search ..... 427/389.9, 393.2, 427/393.4; 8/495, 496; 428/96, 265, 267

[56] References Cited

U.S. PATENT DOCUMENTS

| | | | |
|---|---|---|---|
| 2,373,191 | 4/1945 | Landolt | 8/18 |
| 2,890,097 | 6/1959 | Coe | 8/128 |
| 3,537,808 | 11/1970 | Gardon | 8/116.2 |
| 5,032,136 | 7/1991 | Fitzgerald et al. | 8/115.6 |

FOREIGN PATENT DOCUMENTS

| | | | |
|---|---|---|---|
| 5-25783 | 7/1991 | Japan | D06P 5/04 |
| 1259082 | 1/1969 | United Kingdom | D06C 7/02 |

OTHER PUBLICATIONS

Chemical Abstracts 77(24):153679t, 1971.
Chemical Abstracts 116(20):196170m, Dec., 1991.
Chemical Abstracts 119(20):205414k, Nov., 1991.

*Primary Examiner*—Michael Lusignan
*Attorney, Agent, or Firm*—Terry T. Moyer; Timothy J. Monahan

[57] ABSTRACT

A method to improve the bleach resistance of a textile fiber is provided by having the steps of:

(a) applying a solution or dispersion of a compound of the formula:

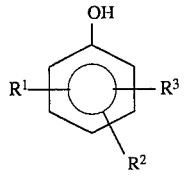

where $R^1$ and $R^2$ are independently selected from the group consisting of H, $CO_2R_4$, $SO_3H$, $PO_3H$, $CON(R^4)_2$, OH, $C_1$–$C_4$ alkyl, $C_1$–$C_4$ alkoxy, and halo, where $R^4$ is H or $C_1$–$C_4$ alkyl;

$R^3$ is selected from the group consisting of H, $C_1$–$C_4$ alkyl, $C_1$–$C_4$ alkenyl, $C_1$–$C_4$ alkylenephenyl, phenyl and $COR^5$, where $R^5$ is $C_1$–$C_4$ alkyl, phenyl or benzyl, any of which may be substituted with up to two groups from $R_2$; and salts of such compounds; in a solvent selected from the group consisting of water and $C_1$–$C_4$ alcohol; and (b) drying said textile fiber to evaporate said solvent and deposit a non-volatile coating of said phenolic compound on a surface of said fiber.

20 Claims, No Drawings

METHOD FOR IMPROVING THE BLEACH RESISTANCE OF DYED TEXTILE FIBER AND PRODUCT MADE THEREBY

BACKGROUND OF THE INVENTION

This invention relates to deposition of a phenolic compound on a dyed textile fiber to prevent color loss, especially by chemical attack from solutions of chlorine bleach, and to improve colorfastness.

Polymeric coatings have been applied to textile fibers to solve a wide range of problems. It is well known that melamine-formaldehyde, urea-formaldehyde, thiourea-formaldehyde and phenol-formaldehyde resins may be applied to cellulosic fibers to impart anti-creasing properties, prevent shrinking and for fixation of dyestuffs. Additionally, these resins have been found to protect dyed cellulose textiles from color loss when they are exposed to chlorine solutions. In Landolt, U.S. Pat. No. 2,373,191, a process is disclosed for combining a dyed fiber, such as cotton, which has been treated with one of the aforementioned resins and cured, with a fiber, such as wool, which is to be treated in a chlorine solution to prevent shrinkage. Subsequent application of a chlorine solution to the fiber mixture should not discolor the dyed cotton fiber. Recently, formaldehyde has been targeted as a hazardous chemical in the work place and its use has become severely restricted. Other drawbacks of the urea-formaldehyde type resins include yellowing and stiffness imparted to the treated fiber.

A number of known processes are directed to providing permanent press or anti-shrink properties to wool and blends of wool fibers with some type of polymeric film. For example, Intermacom A.G.'s British Patent 1,259,082 discloses in situ formation of a polyamide film on a textile fiber. In situ film formation may be achieved by interfacial polymerization using a diamine and diacid chloride or diacid ester. Alternatively, a polyamide emulsion or solution may be applied to a textile fiber and cured, such as in Coe, U.S. Pat. No. 2,890,097. These processes have limited applications to the treatment of carpet, since they tend to impart a harsh hand to the finished product and have not been demonstrated to impart bleach resistance to dyed textile fibers.

Textile floor coverings, particularly polyamide pile carpet, have been the focus of a variety of protective treatments. Sulfonated phenol-formaldehyde condensation products, styrenemaleic anhydride copolymer and polymers and copolymers of methacrylic acid have been applied to polyamide fibers to prevent staining, and represent the "stain blocker" technology. Ozone protection has been sought by coating polyamide fibers with one or more of N,N'-disubstituted thioureas, polythioureas, tertiary amines formed by the reaction of epoxides and amines and organic phosphites. Also, a combination of film-forming polyvinyl chloride and water insoluble organic phosphate ester has been applied to polyamide fiber to provide flame retardancy.

Despite the availability of the aforementioned treatments, serious shortcomings remain in protecting floor covering from discoloration by bleach. This problem is especially prevalent at health care installations where bleach solutions are routinely used to disinfect furniture, equipment, fixtures, and the interior of the building. Even a spill of a dilute bleach solution, as low as 0.05 wt. % solution of sodium hypochlorite, can ruin a section of carpet.

One approach to eliminating the risk of discoloration caused by bleach has been to provide solution dyed fibers.

Thus, the dye is incorporated into the polymer melt prior to spinning. The colorant is evenly distributed throughout the cross-section of the fiber. If the fiber is later exposed to bleach, only the dye at the surface will be affected and the overall color of the fiber will not be significantly diminished.

Nevertheless, solution dyed fibers have several drawbacks, not the least of which is that they are more expensive to produce. Further, solution dyed fibers introduce additional complications to the manufacturing process. Large inventories of each color of fiber must be maintained rather than a single inventory of undyed fibers, which can later be dyed to the desired color. If patterning is desired, one must either tuft the carpet with two or more different colored yarns or print the pattern over the base color. The first alternative is very expensive. Overprinted patterns, which are only applied to the surface of the fiber, are typically used, but the patterns are subject to bleach attack.

In addition to the problems encountered from bleach attack, many dyed textile fibers, especially those incorporated into floor coverings, are susceptible to wet crocking. The problem is frequently encountered during shampooing, where the combination of mechanical agitation and detergents particularly is severe.

SUMMARY OF THE INVENTION

Therefore, one of the objects of this invention is to provide an economical dyed textile fiber which is resistant to discoloration by chlorine bleach.

Another object of this invention is to provide a treatment to impart bleach resistance which can be applied after the fiber is dyed or to textiles having a pattern printed thereon.

Yet another object of this invention is to provide a treatment for imparting bleach resistance which does not contain formaldehyde, discolor or adversely impact on the hand of the textile fiber.

A further object of this invention is to provide a treatment which will improve the colorfastness of dyed textile fiber, especially with regard to wet crocking and shampooing.

Accordingly, a method for treating a dyed textile fiber is provided having the steps of applying a solution or dispersion of a phenolic compound in an aqueous or $C_1$–$C_4$ alcohol solvent, and drying the textile fiber to evaporate the solvent, leaving the phenolic compound deposited on the surface. In one embodiment, the phenolic compound has an acid substituent and an aqueous solution of the compound is provided by increasing the pH to form a soluble salt. After the aqueous solution is applied to a textile fiber, the pH is lowered by the addition of a second solution. The method is especially useful in protecting dyed, polyamide textile fiber. A textile product made according to the above method is also included within the scope of the invention.

The invention has the following features and advantages:

- the treatment solution or dispersion may be applied by conventional padding, baths or spraying;
- emission of organic solvent may be eliminated by use of an aqueous solvent;
- the phenolic compounds which impart bleach resistance are relatively non-toxic, durable and have little or no adverse impact on the hand of the fiber; and
- the treatment method does not require that the textile fiber be heated in a bath for extended periods, or otherwise simulate disperse or acid dyeing conditions.

DESCRIPTION OF THE PREFERRED EMBODIMENT OF THE INVENTION

Without limiting the scope of the invention, the preferred features and embodiment of the invention is hereinafter set forth. The object of the invention is to provide dyed textile fiber with protection from chemical attack by chlorine bleach, which is known to discolor the dye, and improved colorfastness. The most common route of exposure to damage occurs when cleaning solutions or disinfectants containing sodium hypochlorite are spilled on carpet. Nylon or polyamide fiber is used predominantly as the face material for floor covering and is the focus of the present invention.

Of course, an important criteria in evaluating the treatment is the degree to which the textile fiber is protected from discoloration when exposed to a chlorine bleach solution. For disinfecting purposes, the Center for Disease Control recommends a 0.05% solution of sodium hypochlorite for non-porous surfaces, such as counter tops, and a 0.5% solution for porous surfaces, such as grout. Sodium hypochlorite is referred to generally herein as chlorine bleach or bleach. Spills of bleach solution may remain unattended on the carpet for hours or even days, which adds to the strain placed on any protective treatment.

Additionally, the protective treatment should be durable, be able to withstand foot traffic and multiple washings, and improve colorfastness. With regard to cleaning the carpet with "wet" techniques, such as hot water extraction, it is important that the treatment be water insoluble. The protective treatment should have a minimum impact on the physical characteristics of the textile fiber. Therefore, the treatment should not impart a harsh hand to the fiber, cause matting or yellowing.

Heightened environmental awareness has limited the acceptable monomers, polymers and solvents which may be used in a protective treatment. For example, resins containing formaldehyde and organic solvents, especially those containing aromatics, are undesirable. Even treatments employing less toxic organic solvents can substantially increase manufacturing costs when emission controls are required.

The bleach resistance treatment is applicable to both natural and synthetic textile fibers. Thus, by way of example, fibers made from the following materials may be effectively treated according to the methods disclosed herein: polyamides, polyesters, polyolefins, acrylics, and cellulosic fibers such as cotton and rayon. The treatment method is especially useful on polyamide fibers, particularly Nylon 6 and Nylon 6,6. The term "fiber" is used in a broad sense and is intended to include both staple fibers and filaments. It is not material to the practice of the invention whether the fibers are treated prior to or after being formed into a textile product as long as the fiber has first been dyed. Accordingly, the fiber may be treated in the form of a staple fiber, filament, yarn, woven, knitted, or nonwoven fabric, or adhered to a substrate as by tufting or adhesion. From a manufacturing point of view, since most fibers are dyed after being formed into a textile product, the bleach resistance treatment will usually be applied to a fabric or floor covering product.

The present treatment method has applications when any dye which is susceptible to discoloration by chlorine bleach, is used to color textile fibers. The dye may be fixed to the surface of the textile fiber by, for example, chemical reaction, ionic association or with a binder. Representative examples of types of dyes which may be protected by the instant treatment include acid dyes, basic dyes, cationic dyes, direct dyes, dispersed dyes, fiber-reactive dyes, metalized dyes, pre-metalized dyes, and vat dyes. Classes of dyes which are particularly susceptible to attack by hypochlorite ions are acid dyes and fiber reactive dyes. Selection of an appropriate dye for a particular type of fiber is well within the knowledge of those with skill in the art. Likewise, application of the dye to a particular textile product such as by yarn dyeing, range dyeing, jet dyeing, solution dyeing or other conventional techniques, is a routine matter. Textile products containing a base color, including those made of solution dyed synthetic fibers, which have been overprinted with a pattern, such as by ink jet printing, screen printing, or gravure printing, may be treated to provide bleach resistance. Since the method of imparting bleach resistance to the textile fiber comprises forming a non-volatile, polymeric salt film on the fiber surface, the particular dye or dyeing technique is not considered critical.

Generally, bleach resistance is imparted to a textile fiber by applying a solution or dispersion of a phenolic compound to the fiber, evaporating the solvent, leaving the phenolic compound deposited or coated on the surface of the fiber. Suitable phenolic compounds ay be characterized by the formula:

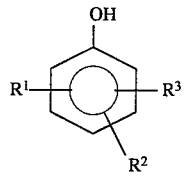

where $R^1$ and $R^2$ are independently selected from the group consisting of H, $CO_2R^4$, $SO_3H$, $PO_3H$ $CON(R^4)_2$, OH, $C_1$–C4 alkyl, $C_1$–$C_4$ alkoxy, and halo, where $R^4$ is H or $C_1$–$C_4$ alkyl; and $R^3$ is selected from the group consisting of H, $C_1$–$C_4$ alkyl, $C_1$–$C_4$ alkenyl, $C_1$–$C_4$ alkylenephenyl, phenyl and $COR^5$, where $R^5$ is $C_1$–$C_4$ alkyl, phenyl or benzyl, any of which groups may be substituted with up to two groups from $R^2$; and salts of such compounds.

By way of example, suitable salts include combinations of the phenolic compounds having an acid functionality with alkali and alkaline earth metals, and quaternary ammonium compounds, such as ammonium and quaternary amines.

In a preferred embodiment, the phenolic compound has at least one acid functionality and $R^1$ is selected from the group consisting of H, $CO_2H$, $SO_3$ H and $PO_3H$;

$R^2$ is selected from the group consisting of H, $CO_2H$, $SO_3H$, $PO_3H$, OH, $C_1$–$C_4$ alkyl, $C_1$–$C_4$ alkoxy and C1; and $R^3$ is selected from the group consisting of H and $COR^5$ where $R^5$ is phenyl, which may be substituted with up to two groups from $R_2$;

with the proviso that $R^1$ is an acid or $R^5$ is substituted with an acid group; and salts of such compounds.

Most preferably, $R^1$ is selected from the group consisting of H, $CO_2H$ and $SO_3H$; $R^2$ is selected from the group consisting of H, $CO_2H$, $SO_3H$, OH and $C_1$–$C_4$ alkoxy; and $R^3$ is selected from H and $COR^5$, where $R^5$ is phenyl, which may be substituted with up to two groups from $R^2$; with the proviso that $R^1$ is an acid or $R^5$ is substituted with an acid group; and salts of such compounds.

Examples of phenolic compounds which may be advantageously employed include hydroxy benzoic acids, dihydroxy benzoic acids and dihydroxy benzophenones.

The phenolic compounds may be made into a dispersion in water or organic solvent using a conventional ball mill or other intensive mixing equipment, as is well known. Emulsifying agents, such as nonionic emulsifiers, are typically employed to enhance the stability of the dispersion. Alternatively, the phenolic compound is dissolved in water or organic solvent and provided in solution form. In general, the phenolic compound concentration in the dispersion or solution ranges from 1 to 30 wt %, preferably from 5 to 20 wt %. The organic solvent, is preferably a $C_1$–$C_4$ alcohol, to minimize problems associated with toxicity, emissions and interaction with the textile fiber.

The bleach resistance treatment is applied to a dyed textile fiber, which may be in the form of a staple fiber, filament, yarn, fabric, or adhered to a substrate. Any of a number of conventional techniques for wetting a textile fiber with a liquid dispersion or solution may be used. For example, the treatment may be applied to pile carpet by padding, spraying, or immersion in a bath. The treatment dispersion or solution can be applied to carpet which has already been installed, and may even be accompanied by mechanical agitation to ensure thorough wetting. The wet pick up is generally from 5 to about 150 wt. % based on the dry weight of the textile fiber, not including a substrate, depending on the method of application. A wet pick up of approximately 25% of the weight of the textile fiber is typical.

The amount of treatment dispersion or solution applied to the textile fiber may conveniently be gauged in terms of the weight percent of solids per weight of fiber, which after the fiber is dried, will represent the weight percent of the phenolic compound deposited on the fiber. The lower limit of application believed to provide at least a modicum of protection is about 0.5 weight percent solids per weight of fiber. The amount of solids applied may be increased up until the point that an adverse effect on the hand and matting of the textile fibers is observed. As a practical matter, diminishing returns of increased protection versus cost will be seen after approximately 10 wt .% solids per weight of fiber is reached. Preferably, from 2 to 7 wt. % solids per textile fiber is achieved by application of the treatment.

In one embodiment, a phenolic compound having at least one acid functionality is dissolved in water and applied to a textile fiber. In many cases, the phenolic compound will be only sparingly soluble in water. However, by increasing the pH of the solvent to form the salt, the solubility of the phenolic compound may be greatly increased. By way of example, suitable base compounds include sodium hydroxide, potassium hydroxide and ammonium hydroxide. Desired concentrations of the phenolic compound can be achieved by increasing the pH of the treatment solution to between 4 and 12. The conjugate base of the phenolic compound in solution is generally referred to herein as the salt form of the compounds.

After the aqueous treatment solution has been applied to the textile fiber, it may be desirable to lower the pH of the solution, especially in cases where the phenolic compound solution is applied at a pH of greater than 7. A wide variety of acid solutions are suitable for lowering the pH, and criteria being that there should be no adverse effect on the integrity of the fiber or harmful residue. Aqueous acid solutions are preferred. Particularly suitable is a citric acid solution. Preferably, the pH of the treatment solution is returned to neutral or below. In that regard, a buffer, such as sodium citrate, may be useful in maintaining a neutral or acidic pH, and may be added with the citric acid.

Without being bound to a particular theory, it is believed that the benzene ring of the phenolic compound reacts with the hypochlorite ion or hypochlorous acid found in the bleach. Accordingly, the presence of the phenolic compound as a thin coating or film deposited on the surface of fiber, provides a sacrificial barrier, which protects the dye molecules underneath from attack. The phenolic compound adsorbs on the surface of the fiber when the solvent is evaporated.

Following application of the bleach resistance treatment, and subsequent acid solution, if any, the solvent is evaporated from the textile fiber. Conventional equipment used to dry textiles may be employed. Typically, the textile fiber is exposed to temperatures of 100° to 200° C., preferably 110° to 160° C. The length of exposure to the heat will be determined by the time required to evaporate the solvent. When the bleach resistance treatment is provided on textile products which have already been installed, such as carpet, the textile product may be allowed to dry at ambient conditions.

In some instances, an additional measure of protection against bleach may be provided by application of a non-volatile amine, preferably an amino acid, to the textile fiber, along with the phenolic compound. Applications of the amine in the range of 0.25 to 5 wt. % based on the weight of the fiber have been found to be efficacious. Examples of suitable amino acids include $C_2$– $C_{20}$ compounds, in particular, 6-aminohexanoic acid, aminoundeconoic acid, 2-pyrrolidinecarboxylic acid, glycine, cystine, asparagine, glutamine, lysine, arginine, tyrosine, and aminododeconoic acid, and lactams formed from the amino acids.

Additional compounds used to improve the characteristics of textile fibers may be incorporated into the treatment solution so long as they do not interfere with the activity of the phenolic compounds. For example, fluorocarbon polymers which provide anti-soiling and water repellency, and stain blockers such as condensation products containing sulfonated phenols may be employed.

The invention may be further understood by references to the following examples, but the invention is not to be construed to be unduly limited thereby, Unless otherwise indicated, all parts and percentages are by weight.

Several different methods were used successfully to apply the bleach resistant finish to the carpet. These general methods are outlined below.

Method A

If the phenolic compound contains an acidic substituent, it can often be applied to the carpet as a homogeneous aqueous solution of the conjugate base. For example, a slurry of the active material or materials in water can be prepared and then sufficient base added to provide a clear solution. The pH of this solution can be neutralized on the carpet by a subsequent treatment with an acidic solution to give the desired final pH.

Method B

A second method of application involves simple dissolution of the phenolic compound in an appropriate solvent, such as isopropyl alcohol. Other finish materials, such as soil repellents, which are not soluble in the chosen solvent, can be applied in a second treatment.

Method C

The phenolic compound is applied as an aqueous dispersion. Again, other finish materials are added in a second treatment.

Evaluation

Samples were visually rated by using a set of standards prepared by subjecting dyed, untreated carpet samples to 5.25% sodium hypochlorite solution for varying lengths of time (0 minutes, 15 minutes, 30 minutes, 45 minutes, 1 hour, 4 hours, 8 hours, 16 hours and 24 hours). The treated samples of Examples 1 through 20 were exposed to sodium hypochlorite solution concentrations of 5.25% (100% strength bleach) and 2.1% (40% strength bleach) for 24 hours, washed and dried. The exposed regions were visually compared to the standard spots to find the closest match and assigned the corresponding "bleach number". If an exposed region of a treated sample fell midway between two standard spots, interpolation was employed (e.g., if between 0 minute and 15 minute standard spots, a bleach number of 0.125 (for 0.125 hours) was assigned). Thus, a sample which showed no improvement over the control would receive a bleach number of 24 for the 5.25% sodium hypochlorite spot (the 100% strength bleach number), while a perfect sample that showed no color change in the exposed region would receive a bleach number of zero.

Example 1

[8% Salicylic Acid]

Following the procedure described for Method A, a solution prepared from a slurry of salicylic acid (16 grams) in water (184 grams) by addition of 50% aqueous sodium hydroxide (final pH=7.5) was sprayed on a nylon 6,6 cut pile bonded carpet tile (28 oz/yd$^2$ face weight) stock dyed with standard and pre-metalized acid dyes to give 35% wet pick-up (wpu) based on the dry weight of the nylon face fiber. While still wet, a second mixture containing a fluorocarbon water repellent (3.2 grams) and citric acid (13 grams) in water (183.8 grams) was sprayed on the sample to give 35% wpu based on the face weight. The sample was dried in a 100° C. oven for one hour. The carpet shows no appreciable change in appearance. The sample was subjected to 5.25% and 2.1% solutions of sodium hypochlorite for 24 hours. The samples were washed with water and dried at 100° C. in a laboratory oven. 40% bleach number=0.125, 100% bleach number=0.5.

Example 2

[8% p-Hydroxybenzoic acid]

The procedure of Example 1 was repeated in all respects except p-hydroxybenzoic acid was substituted for salicylic acid. 40% bleach number=0.125, 100% bleach number=0.75.

Example 3

[8% 2,4-Dihydroxybenzoic acid]

A slurry of 2,4-dihydroxybenzoic acid (16 grams) in water (184 grams) was treated with 50% sodium hydroxide until a homogeneous solution was obtained. This solution was applied to a dyed carpet tile as described in Example 1 (35% wet pick-up based on the face weight). While still wet a second aqueous solution containing 3.5% citric acid and 1.6% fluorocarbon water repellent was applied at 35% wpu by spraying. The samples were dried at 100° C. and bleach resistance evaluated as described in Example 1.40% bleach number=0.125, 100% bleach number=0.5.

Example 4

[8% 4-Hydroxybenzenesulfonic acid]

The procedure of Example 3 was repeated in all respects except 4-hydroxybenzenesulfonic acid was substituted for 2,4-dihydroxybenzoic acid. 40% bleach number=2.5, 100% bleach number=4.

Example 5

[8% 4-tButylphenol]

According to Method B, an 8% solution of 4-t-butylphenol in isopropanol was sprayed on a dyed carpet tile to give 35% wpu. While still wet a 1.6% aqueous solution of fluorocarbon water repellent was also applied by spraying (35% wpu). After drying at 100° C. the resistance to bleach was measured as described in Example 1. 40% bleach number=0.5, 100% bleach number=1.

Example 6

[St 2,4-Dihydroxybenzophenone]

The procedure of Example 5 was repeated in all respects except 2,4-dihydroxybenzophenone was substituted for 4-t-butylphenol. 40% bleach number=0.5, 100% bleach number=1.

Example 7

[8% Salicylamide]

The procedure of Example 5 was repeated in all respects except salicylamide was substituted for 4-t-butylphenol. 40% bleach number=0.5, 100% bleach number=1.

Example 8

[8% Phenol]

The procedure of Example 5 was repeated in all respects except phenol was substituted for 4-t-butylphenol. 40% bleach number=0.5, 100% bleach number=1.

Example 9

[8% 2,2'-Dihydroxy4,4'-dimethoxybenzophenone]

The procedure of Example 5 was repeated in all respects except 2,2'-dihydroxy4,4'-dimethoxybenzophenone was substituted for 4-t-butylphenol. 40% bleach number=0.125, 100% bleach number=2.5.

Example 10

[8% 3-Chlorophenol]

The procedure of Example 5 was repeated in all respects except 3-chlorophenol was substituted for 4-t-butylphenol. 40% bleach number=0.75, 100% bleach number=2.5.

Example 11

[8% 2-t-Butylphenol]

The procedure of Example 5 was repeated in all respects except 2-butylphenol was substituted for 4-t-butylphenol. 40% bleach number=0.5, 100% bleach number=4.

Example 12

[8% 2-t-Butyl-4-methylphenol]

The procedure of Example 5 was repeated in all respects except 2-t-butyl-4-methylphenol was substituted for 4-t-butylphenol. 40% bleach number=1,100% bleach number=4.

Example 13

[8% 2,6-Di-t-butyl-4-methylphenol]

The procedure of Example 5 was repeated in all respects except 2,6-di-t-butyl-4-methylphenol was substituted for 4-t-butylphenol. 40% bleach number=1, 100% bleach number=4.

Example 14

[8% 4-Chlorophenol]

The procedure of Example 5 was repeated in all respects except 4-chlorophenol was substituted for 4-t-butylphenol. 40% bleach number=0.75, 100% bleach number=4.

Example 15

[8% Ethyl 3-hydroxybenzoate]

The procedure of Example 5 was repeated in all respects except ethyl 3-hydroxybenzoate was substituted for 4-t-butylphenol. 40% bleach number=1, 100% bleach number=4.

Example 16

[S% 2-Hydroxy-4-methoxybenzophenone]

The procedure of Example 5 was repeated in all respects except 2-hydroxy-4-methoxybenzophenone was substituted for 4-t-butylphenol. 40% bleach number=0.75, 100% bleach number=4.

Example 17

[8% Salicylic Acid, 4% Cystine]

Following the procedure described for Method A, a solution prepared from a slurry of salicylic acid (16 grams) and cystine (8 grams) in water (176 grams) by addition of 50% aqueous sodium hydroxide (final pH=11) was sprayed on a dyed carpet tile. While still wet an aqueous solution containing 10% citric acid and 1.6% fluorocarbon water repellent was sprayed on (35% wpu). After drying at 100° C. the resistance to bleach was measured as described in Example 1. 40% bleach number=0.125, 100% bleach number=0.125.

Example 18

[8% p-Hydroxybenzoic acid, 4% Cystine]

The procedure of Example 18 was repeated in all respects except p-hydroxybenzoic acid was substituted for salicylic acid. 40% Bleach number=0.25, 100% bleach number=0.5.

Example 19

[8% Salicylic Acid, 4% Cystine, dispersion]

Following Method C, a slurry of salicylic acid (50 grams), cystine (25 grams) and Synfac 2216, a nonionic dispersant available from Milliken Chemical, a Division of Milliken & Company, South Carolina, U.S.A. (7.5 grams) in water (117.5 grams) was dispersed with an Eppenbach homogenizer-mixer for about three hours. The mixture was then diluted with water (425 grams)and sprayed on a dyed carpet tile (35% wpu). After drying at 100° C. the resistance to bleach was measured as described in Example 1. 40% bleach number=0.25, 100% bleach number=0.5.

The following comparative example was prepared according to JP 5[1993]-25783.

Example 20

[5% Bis Phenol A as in Japanese patent #05-25783]

Water (700 mL) was heated to 80° C. and three samples of carpet tile totaling 16.7 grams of nylon face fiber were placed in the hot liquid. While maintaining a temperature of 80° C. a solution of 2,2-bis(4-hydroxyphenyl)propane (0.83 grams) in isopropyl alcohol (7.47 grams) was added dropwise over about 5 minutes. Following addition the mixture was heated at 80° C. for 50 minutes and allowed to cool to ambient temperature. The carpet samples were rinsed and dried in an oven at 100° C. for 1 hour. A bleach resistance test was run as described in Example 1, but the samples could not be rated due to excessive yellowing in the areas exposed to bleach.

There are, of course, many alternate embodiments and modifications which are intended to be included within the scope of the following claims.

What we claim is:

1. A method for treating a dyed synthetic textile fiber to improve its bleach resistance, comprising the steps of:

(a) applying a solution or dispersion of a compound of the formula:

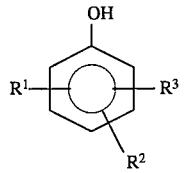

where $R^1$ and $R^2$ are independently selected from the group consisting of H, $CO_2R^4$, $SO_3H$, $PO_3H$, $CON(R^4)_2$, OH, $C_1C_4$ alkyl, $C_1$–$C_4$ alkoxy, and halo, where $R^4$ is H or $C_1$–$C_4$ alkyl;

$R^3$ is selected from the group consisting of H, $C_1$–$C_4$ alkyl, $C_1$–$C_4$ alkenyl, $C_1$–$C_4$ alkylenephenyl and phenyl, any of which may be substituted with up to two groups from $R^2$; and salts of such compounds; in a solvent selected from the group consisting of water and $C_1$–$C_4$ alcohol; and (b) drying said textile fiber to evaporate said solvent and deposit a non-volatile coating of said phenolic compound on a surface of said fiber.

2. The method of claim 1 wherein from 0.5 to 10 wt. % of said phenolic compound is deposited on said fiber.

3. A method of claim 2 wherein $R^1$ is selected from the group consisting of $CO_2H$, $SO_3H$ and $PO_3H$; and $R^3$ is H.

4. The method of claim 1 wherein $R^1$ is selected from the group consisting of $CO_2R^4$ and $CO_2H$; $R^2$ is H, OH, $C_1$–$C_4$ alkyl or $C_1$–$C_4$ alkoxy and $R^3$ is H.

5. The method of claim 4 wherein said fiber is polyamide.

6. The method of claim 1 wherein $R^1$ is selected from the group consisting of $CO^2R^4$ and $CO_2H$, $R^2$ is H, and $R^3$ is H.

7. The method of claim 6 wherein said phenolic compound is in the form of a salt in an aqueous solution.

8. The method of claim 7 wherein 0.5 to 10 wt. % of said phenolic compound is deposited on said fiber.

9. The method of claim 7 wherein from 2 to 7 wt. % of said phenolic compound is deposited on said fiber and said fiber is a polyamide fiber.

10. The method of claim 1 wherein said phenolic compound is selected from the group consisting of hydroxy benzoic acids and dihydroxy benzoic acids.

11. A method for treating a dyed polyamide or polyester textile fiber to improve its bleach resistance, consisting essentially of the steps of:

(a) applying an aqueous solution of a compound of the formula:

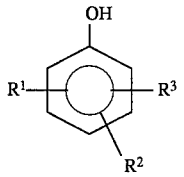

$R_1$ is selected from the group consisting of H, $CO_2H$, $SO_3H$ and $PO_3H$;

$R^2$ is selected from the group consisting of H, $CO_2H$, $SO_3H$, $PO_3H$, OH, $C_1$–$C_4$ alkyl, $C_1$–$C_4$ alkoxy and Cl;

$R^3$ is selected from the group consisting of H and $C_1$–$C_4$ alkylenephenyl;

with the proviso that $R^1$ is an acid or $R^5$ is substituted with an acid group;

and salts of such compounds;

(b) applying an aqueous acidic solution to said textile fiber to lower a pH to 7 or below; and (c) drying said textile fiber to evaporate said solvent leaving a non-volatile coating of said phenolic compound on the surface of said textile.

12. The method of claim 11 wherein from 0.5 to 10 wt. % of said phenolic compound is deposited on said fiber.

13. The method of claim 12 wherein said acidic solution is an aqueous solution of citric acid.

14. The method of claim 13 wherein said phenolic compound is selected from the group consisting of hydroxy benzoic acids and dihydroxy benzoic acids.

15. The method of claim 11 wherein from 2 to 7 wt. % of said phenolic compound is deposited on said fiber and said fiber is a polyamide fiber.

16. A bleach resistant carpet having polyamide or polyester fibers product of the process comprising the steps of:

(a) applying to the fibers a solution or dispersion of a compound of the formula:

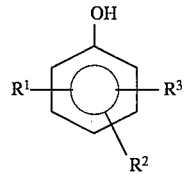

where $R^1$ and $R^2$ are independently selected from the group consisting of H, $CO_2R^4$, $SO_3H$, $PO_3H$, $CON(R^4)_2$, OH, $C_1$–$C_4$ alkyl, $C_1$–$C_4$ alkoxy, and halo, where $R^4$ is H or $C_1$–$C_4$ alkyl;

$R^3$ is selected from the group consisting of H, $C_1$–$C_4$ alkyl, $C_1$–$C_4$ alkenyl, $C_1$–$C_4$ alkylenephenyl and phenyl, any of which may be substituted with up to two groups from $R^2$; and salts of such compounds, in a solvent selected from the group consisting of water and $C_1$–$C_4$ alcohol; and (b) drying said fiber to evaporate said solvent and deposit a non-volatile coating of said phenolic compound on a surface of said fiber.

17. The textile product of claim 16 wherein from 0.5 to 10 wt. % of said phenolic compound is deposited on said fiber.

18. The textile product of claim 17 wherein $R_1$ is selected from the group consisting of $CO_2H$, $SO_3H$ and $PO_3H$;

$R^2$ is selected from the group consisting of H, OH, $C_1$–$C_4$ alkyl, $C_1$–$C_4$ alkoxy; and $R^3$ is H.

19. The textile product of claim 16 wherein $R^1$ is selected from the group consisting of $CO_2R^4$ and $CO_2H$, $R^2$ is selected from the group consisting of H, OH and $C_1$–$C_4$ alkoxy; and $R^3$ is selected from H and $C_1$–$C_4$ alkylenephenyl, which may be substituted with up to two groups from $R^2$.

20. The textile product of claim 16 wherein from 2 to 7 wt. % of said phenolic compound is deposited on said fiber, said fiber is a polyamide fiber, said phenolic compound is selected from the group consisting of hydroxy benzoic acids and dihydroxy benzoic acids, and further wherein said phenolic compound is in the form of a salt in an aqueous solution when applied to said textile fiber.

* * * * *